US005708760A

United States Patent [19]

Hsiao et al.

[11] Patent Number: 5,708,760

[45] Date of Patent: Jan. 13, 1998

[54] VOICE ADDRESS/DATA MEMORY FOR SPEECH SYNTHESIZING SYSTEM

[75] Inventors: Chieh-Sheng Hsiao; Chien-Hsin Yang, both of Taipei; Chung-Chin Hung, Taipei Hsien, all of Taiwan

[73] Assignee: United Microelectronics Corporation, Taiwan, China

[21] Appl. No.: 512,432

[22] Filed: Aug. 8, 1995

[51] Int. Cl.[6] ..... G10K 3/00

[52] U.S. Cl. ..... 395/2.67; 395/2.1; 395/2.76; 395/2.77

[58] Field of Search ..... 395/2.1, 2.67, 395/2.76, 2.77

[56] References Cited

U.S. PATENT DOCUMENTS 4,429,367 1/1984 Ikeda ..... 395/2.76
5,193,207 3/1993 Vegt et al. ..... 395/800

*Primary Examiner*—Allen R. MacDonald
*Assistant Examiner*—Alphonso A. Collins
*Attorney, Agent, or Firm*—Cushman Darby & Cushman IP Group of Pillsbury Madison & Sutro LLP

[57] ABSTRACT

A voice address/data memory for a speech synthesizing system is divided into a basic memory layer for storing a plurality of basic voice data units, and one or more address pointer memory layers for storing a plurality of address pointer sets. The basic memory layer includes a plurality of memory tables, each of which stores one basic voice data unit. The address pointer sets are used to address the basic memory layer in order to combine part of the basic voice data units for generating a desired speech signal in the speech synthesizing system. Each memory table further stores an ending code for indicating the ending of one basic voice data unit in order to simplify the data processing. The basic memory layer and the address pointer memory layers are arranged within continuous memory regions of the voice address/data memory to efficiently utilize the memory space.

6 Claims, 4 Drawing Sheets

VOICE ADDRESS/DATA MEMORY FOR SPEECH SYNTHESIZING SYSTEM

BACKGROUND OF THE INVENTION

1. Field of the Invention

The present invention relates to a speech synthesizing system, and more particularly to a voice address/data memory for the speech synthesizing system.

2. Description of the Related Art

In general, a speech synthesizing system selectively utilizes voice data stored in its memory to generate synthesized speech signals. FIG. 1 schematically shows a block diagram of a conventional speech synthesizing system. In this speech synthesizing system, a central processing unit (CPU) 10 retrieves the selected voice data from a voice data memory 14 according to the address provided by an address counter 16. The selected voice data are synthesized by a speech synthesizer 20 to generate a speech signal. The speech signal is in turn converted by a digital/analog converter (DAC) 22 into an analog form which can be electro-acoustically transduced by a loudspeaker 23. The voice data retrieval is terminated by the address provided from a terminating address register 18.

For flexibility and variety in the synthesized speech, the voice data memory 14 is generally divided into a plurality of memory units to store different basic units, or words, of the voice data. A programmable memory controls the retrieval of the voice data units from several memory units of the voice data memory 14 to construct speech. Different combinations of the voice data units result in different speech signals. This programmable memory is generally designated as a voice address control memory or an address memory 12, as shown in FIG. 1. The voice address control memory 12 stores therein the starting and terminating addresses and the attributes or voice parameters for each voice data unit.

A voice data memory 14, according to conventional voice integrated circuit (IC) architecture, has to be finely divided into a large number of memory units in order to obtain more variations of the speech output. This leads to an increase in the complexity of the voice address control memory 12 and raises costs.

In addition, the voice address control memory 12 of the conventional voice IC has a hardware architecture the specifications of which are hard to alter. It is also generally complicated to adapt the voice address control memory 12 design to some complicated speech outputs. In simple applications, large portions of the voice address control memory 12 may not be used at all, resulting in a waste of resources.

SUMMARY OF THE INVENTION

The present invention provides a voice address/data memory which includes an ending code in each basic unit of voice data to indicate the end of the voice data unit. In this way, the terminating address pointer needed in the above-described prior art can be omitted to simplify the control of voice addresses.

The present invention also provides a voice address/data memory which stores both the voice data units and their corresponding starting addresses and attributes therein for efficient utilization of the memory space.

Further, the present invention provides a voice address/data memory which includes a basic memory layer for storing the voice data units, and a plurality of address pointer memory layers for storing the address pointers and attributes of the voice data units. The address pointer memory layers are used to address to voice data in a hierarchical manner.

In accordance with the present invention, a voice address/data memory for a speech synthesizing system comprises a basic memory layer for storing a plurality of basic voice data units, the basic memory layer including a plurality of memory tables, each of which stores one basic voice data unit; and at least one address pointer memory layer for storing a plurality of address pointer sets, each of which addresses to the basic memory layer in order to combine part of the basic voice data units for generating a predetermined speech signal in the speech synthesizing system.

In accordance with one aspect of the present invention, each of the memory tables further stores an ending code for indicating the ending of the one basic voice data unit. The ending code may be one of the binary codes "11111111" and "00000000". Further, the basic memory layer and the address pointer memory layer are arranged within continuous memory regions of the voice address/data memory.

In accordance with another aspect of the present invention, the voice address/data memory comprises a trigger, a group, a section and word address pointer memory layers, each of which includes a plurality of memory pages. Each memory page stores a set of address pointers. Each address pointer set stored in each memory page of the trigger address pointer memory layer addresses to part of the memory pages of the group address pointer memory layer. Each address pointer set stored in each memory page of the group address pointer memory layer addresses to part of the memory pages of the section address pointer memory layer. Each address pointer set stored in each memory page of the section address pointer memory layer addresses to part of the memory pages of the word address pointer memory layer. Each address pointer set stored in each memory page of the word address pointer memory layer addresses to part of the memory tables of the basic memory layer.

In accordance with further aspect of the present invention, each memory page includes a plurality of memory segments, each of which stores an address pointer, and an ending recognition code for indicating whether the addressing to the other memory layer should be ended. The ending recognition code uses one of the binary codes "11111111" and "00000000" to indicate the addressing to the other memory layer should be ended. Each memory segment may further store an attribute for defining the voice parameters of the basic voice data units. Further, the basic memory layer and the trigger, group, section and word address pointer memory layers are arranged within continuous memory regions of the voice address/data memory.

BRIEF DESCRIPTION OF THE DRAWINGS

The present invention can be more fully understood by reference to the following description and accompanying drawings, which form an integral part of this application, wherein.

DETAILED DESCRIPTION OF THE PREFERRED EMBODIMENTS

Figure 2:
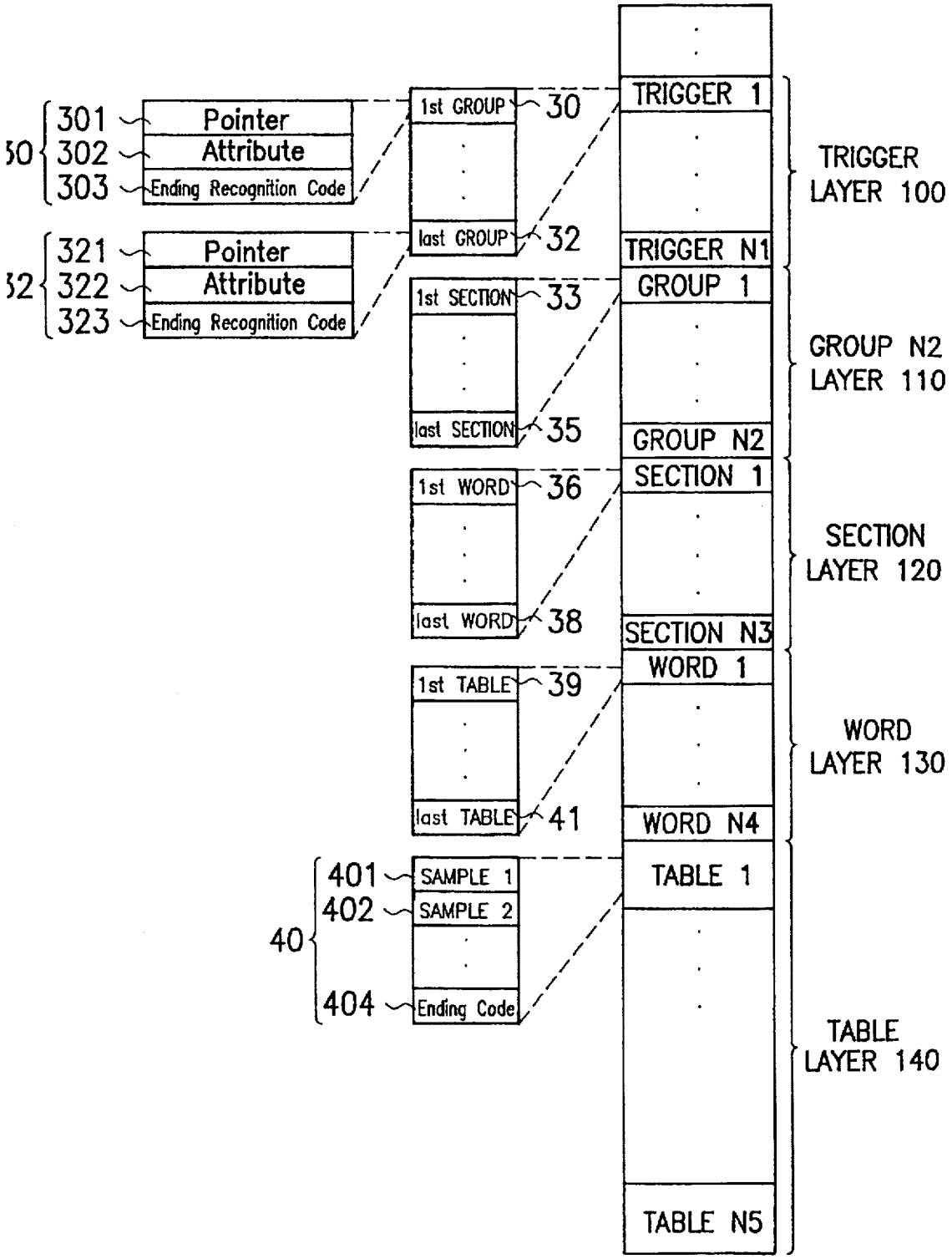
FIG. 2 is a schematic block diagram of a voice address/data memory architecture, according to one preferred embodiment of the present invention.

With reference now to FIG. 2, there is shown a voice address/data memory according to one preferred embodiment of the present invention. The voice address/data memory of FIG. 2 includes a basic memory layer 140, for example a table layer, for storing a plurality of basic units of voice data; and four address pointer memory layers, for example a trigger layer 100, a group layer 110, a section layer 120 and a word layer 130, for storing the address pointers capable of being used to address to the desired voice data unit combinations which can be in turn synthesized to generate different speech signals. The address pointer memory layers 100, 110, 120 and 130, and the basic memory layer 140 are arranged in continuous memory regions of the single voice address/data memory in order to efficiently utilize the memory space.

Each memory layer is divided into a plurality of memory pages. For example, the trigger layer 100 is divided into N1 pages, i.e. trigger 1 through trigger N1, as labeled in FIG. 2. The group layer 110 includes N2 pages, i.e. group 1 through group N2. The section layer 120 includes N3 pages, i.e. section 1 through section N3. The word layer 130 includes N4 pages, i.e., word 1 through word N4. The basic memory or table layer 140 includes N5 pages, i.e. table 1 through table N5.

Each memory page is further divided into a plurality of memory segments. Each memory segment of the address pointer memory layers 100, 110, 120 and 130 is used to store a pointer or address pointer, an attribute or voice parameters, and an ending recognition code. For example, the trigger 1 includes a plurality of memory segments, i.e., first group 30, second group, . . . , and last group 32, as labeled in FIG. 2. The memory segment of the first group 30 stores an address pointer 301, an attribute 302, and an ending recognition code 303. Similarly, the last memory segment of the last group 32 stores an address pointer 321, an attribute 322, and an ending recognition code 323. The address pointers 301, 321 in the trigger layer 100 are used to address to the next memory layer, i.e., the group layer 110. The attributes 302, 322 can be used to define several parameters of the voice data. The ending recognition codes 303, 323 are used to indicate whether the addressing should be ended. The ending recognition code may store an "ending" code or a "not end" code. In a commonly-used 8-bit speech synthesizing system, one of the binary codes "11111111" and "00000000" may be used as the ending code because they are seldom used as the voice data. The "not end" code may be another one of the binary codes "11111111" and "00000000".

Similarly, the group 1 includes a plurality of memory segments, i.e., first section 33, second section, L, and last section 35, as labeled in FIG. 2. Each memory segment 33, 35 in the group layer 110 also stores an address pointer, an attribute, and an ending recognition code. The address pointers in the group layer 110 are used to address to the next memory layer, i.e. the section layer 120. Similarly, the section 1 includes a plurality of memory segments, i.e. first word 36, second word, . . . , and last word 38, as labeled in FIG. 2. Each memory segment 36, 38 in the section layer 120 also stores an address pointer, an attribute, and an ending recognition code. The address pointers in the section layer 120 are used to address to the next memory layer, i.e. the word layer 130. Similarly, the word 1 includes a plurality of memory segments, i.e. first table 39, second table, . . . , and last table 41, as labeled in FIG. 2. Each memory segment 39, 41 also stores an address pointer, an attribute, and an ending recognition code. The address pointers in the word layer 130 are used to address to the next memory layer, i.e. the table or basic memory layer 140.

Each memory page of the basic memory layer or table layer 140 is also divided into a plurality of memory segments for storing a plurality of voice samples and an ending code. For example, the table i stores a plurality of voice samples 40, i.e., sample 1 (401), sample 2 (402), . . . , and an ending code 404, as labeled in FIG. 2. Each table in the table layer 140 may store one basic unit of voice data which can be synthesized to generate a complete speech waveform. The ending code 404 is used to indicate the end of the basic voice data unit.

Figure 3:
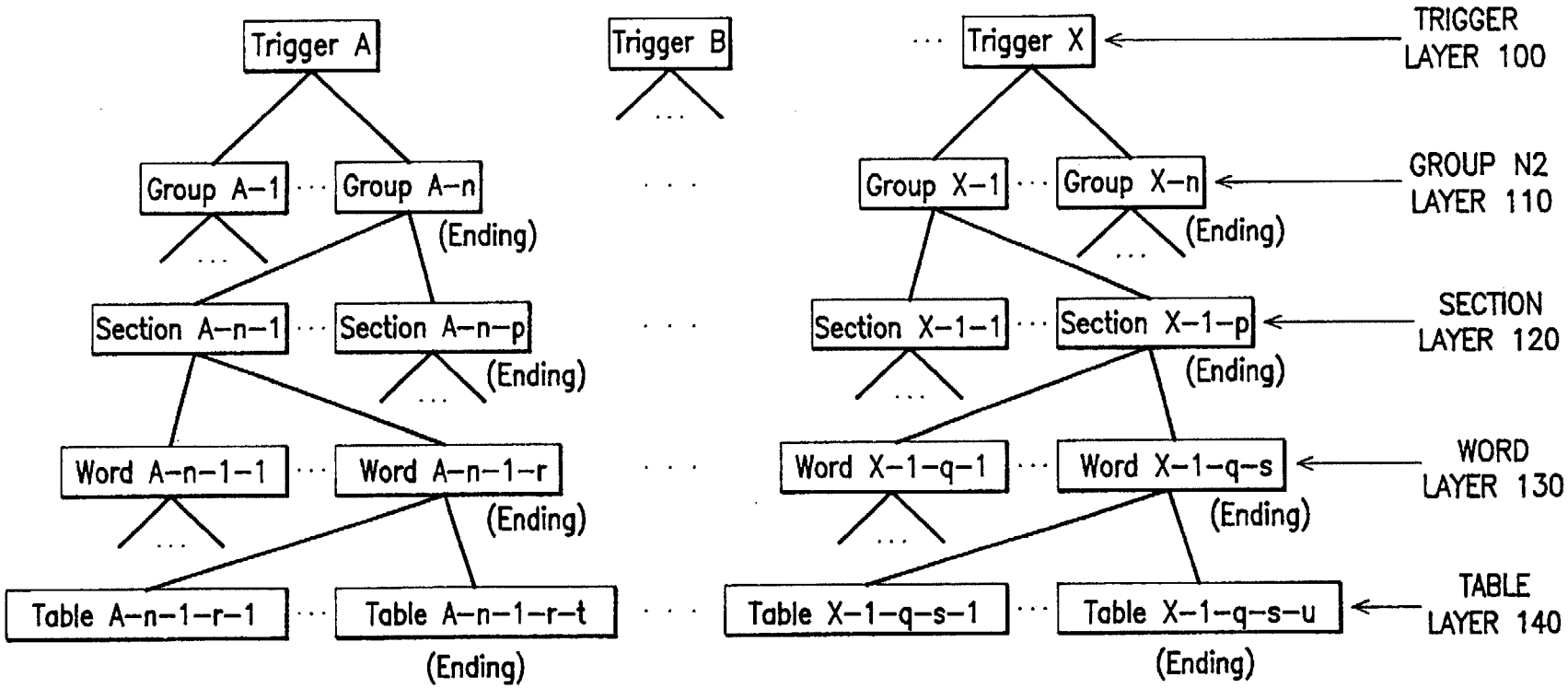
FIG. 3 is a schematic diagram exemplarily illustrating the hierarchical addressing relationship of the voice address/data memory shown in FIG. 2.

According to the architecture of the above-described voice address/data memory of the present invention, a hierarchical addressing manner with excellent flexibility can be achieved. FIG. 3 schematically illustrates the hierarchical addressing manner of the voice address/data memory. There are exemplarily shown in FIG. 3 three triggers A, B, and X in the trigger layer 100, and their addressing flows through the group 110, section 120 and word 130 layers to the table or basic memory layer 140. Since the addressing manner of each trigger is the same, only the trigger A will be described hereinafter. When the trigger A is triggered, the address pointers stored therein are used to address to the group layer 110. The addressing is in sequence along the direction from the first group to the last group of the trigger A, and is ended when the ending code is detected. It is assumed that the nth group of the trigger A stores the ending code. As shown in FIG. 3, the trigger A can address to the groups A-1 through A-n in the group layer 110. Similarly, the address pointers stored in each group A-1 through A-n are then used to address to the section layer 120. For example, the group A-n can address to the sections A-n-1 through A-n-p in the section layer 120 if the ending code is stored in the pth section of the group A-n. Similarly, the address pointers stored in each section A-n-1 through A-n-p are in turn used to address to the word layer 130. For example, the section A-n-1 can address to the words A-n-1-1 through A-n-1-r in the word layer 130 if the ending code is stored in the rth word of the section A-n-1. Similarly, the address pointers stored in each word A-n-1-1 through A-n-1-r are used to address to the table layer 140. For example, the word A-n-1-r can address to the tables A-n-1-r-1 through A-n-1-r-t in the table layer 140 if the ending code is stored in the tth table of the word A-n-1-r. The combination of the voice data units stored in all addressed tables is finally used to generate a desired speech pattern.

It should be understood by those skilled in the art that the number of the address pointer memory layers in the voice address/data memory of the present invention is not intended to be limited to four as described above. In the simplest applications, only one address pointer memory layer may be enough. In very complicated applications, more address pointer memory layers may be needed. In addition, the provision of the ending code can facilitate the interruption of one addressing flow in due course followed by the continuous execution of next addressing flow. Therefore, the excellent flexibility of speech synthesis can be achieved.

Figure 1:
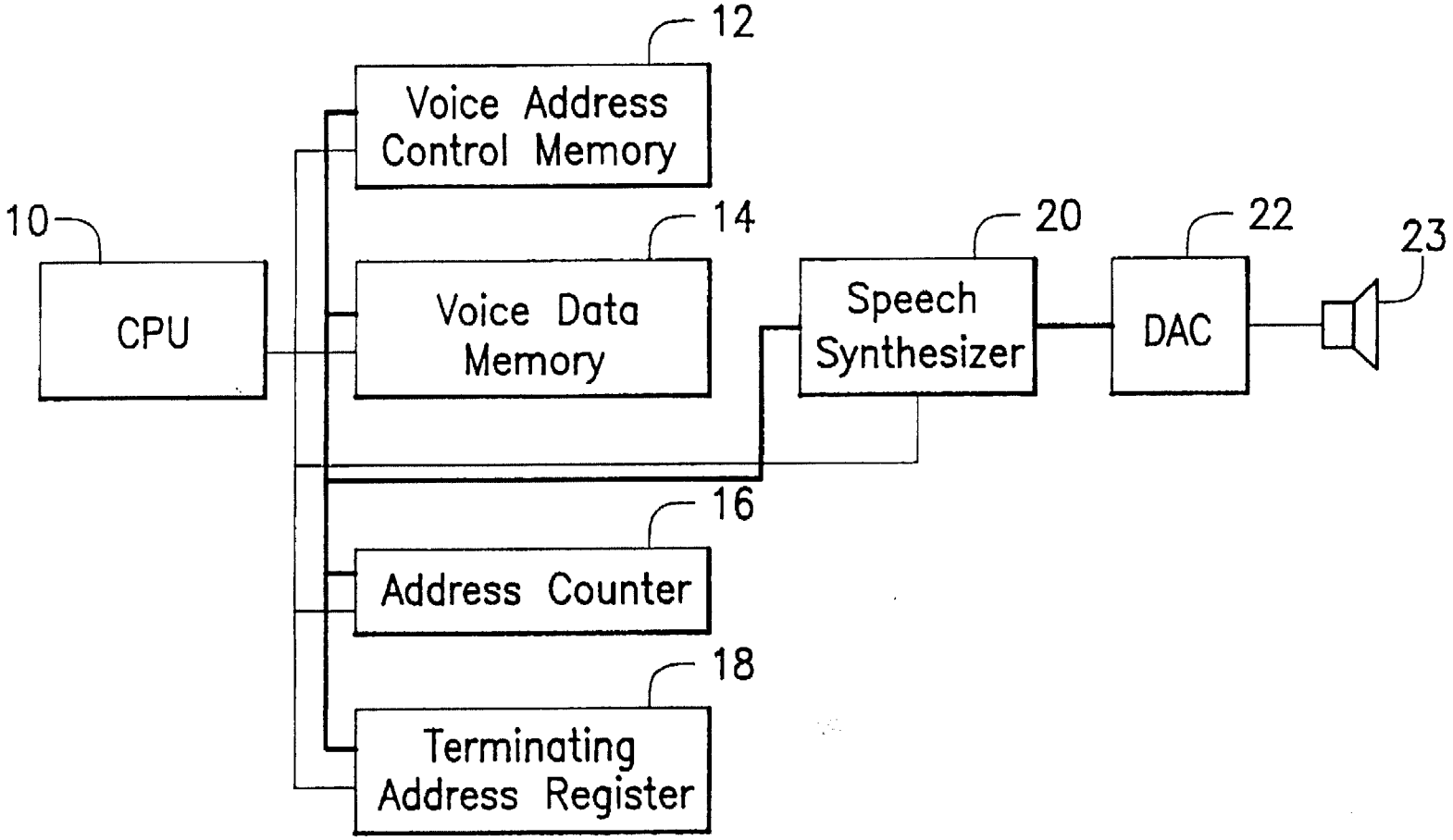
FIG. 1 (PRIOR ART)
FIG. 1 is a schematic block diagram of a conventional speech synthesizing system.
Figure 4:
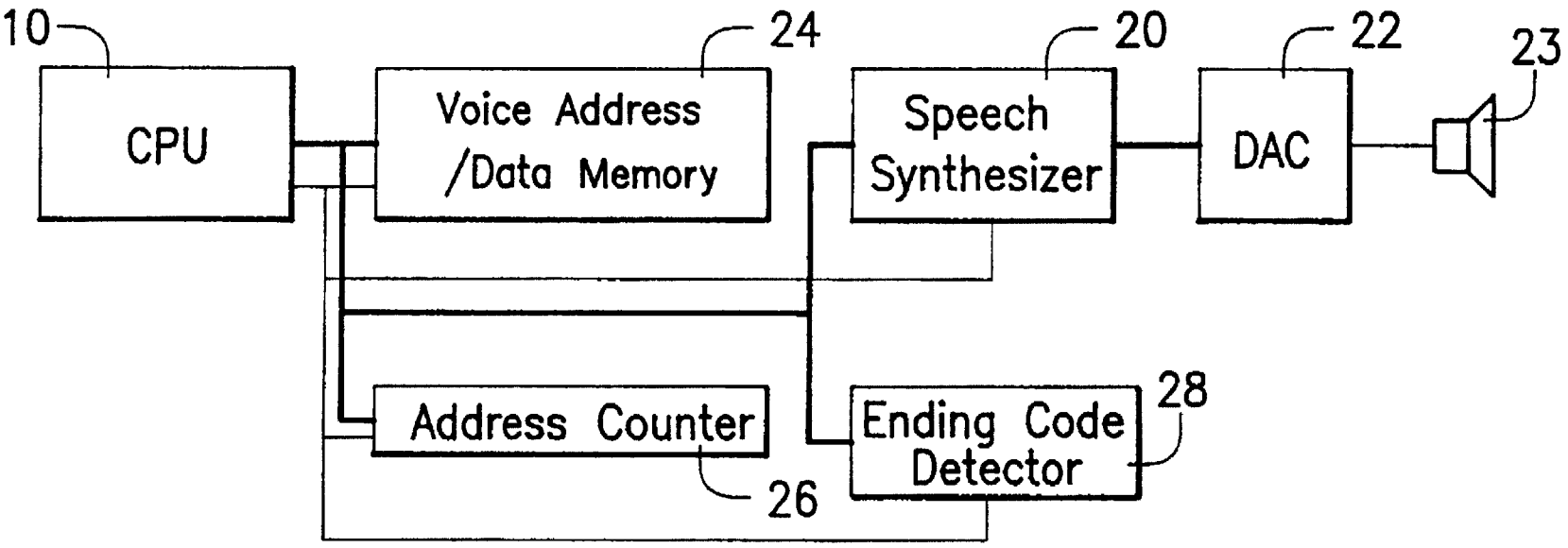
FIG. 4 is a schematic block diagram of a speech synthesizing system using the voice address/data memory of the present invention.

With reference to FIG. 4, there is shown a speech synthesizing system using the voice address/data memory 24 of the present invention. The speech synthesizing system of FIG. 4 similarly includes a CPU 10, an address counter 26, a speech synthesizer 20, a DAC 22, and a loudspeaker 23 as in the conventional speech synthesizing system shown in FIG. 1. The voice address/data memory 24 of the present invention can be triggered by a trigger signal sent from the CPU 10, and is used to replace the voice data memory 14, the voice address control memory 12, and the terminating address register 18 of FIG. 1. An ending code detector 28 is provided in this speech synthesizing system to detect the ending code. The ending code detector 28 may be a comparator which is used to compare the ending recognition code with the predetermined ending code so as to provide an ending signal in due time. The provisions of the ending code in the voice address/data memory 24 and the ending code detector 28 in the speech synthesizing system can enhance the data processing efficiency. In the prior art system of FIG. 1, the confirmation of the terminating address is executed by storing the terminating address provided by the voice address control memory 12 in the terminating address register 18, and comparing the stored terminating address with the addresses of the voice data memory 14. This leads to a large amount of data processing, and thus is inefficient.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A voice address/data memory for a speech synthesizing system comprising:

a basic memory layer for storing a plurality of basic voice data units, said basic memory layer including a plurality of memory tables, each of which stores one basic voice data unit; and at least one address pointer memory layer for storing a plurality of address pointer sets, each of which addresses said basic memory layer in order to combine part of said plurality of basic voice data units for generating a predetermined speech signal in said speech synthesizing system, wherein each of said memory tables further stores an ending code for indicating the end of said one basic voice data unit, and wherein said voice address/data memory comprises a trigger, a group, a section and word address pointer memory layers, each of which includes a plurality of memory pages, each memory page storing a set of address pointers, each address pointer set stored in each memory page of said trigger address pointer memory layer addressing to part of said memory pages of said group address pointer memory layer, each address pointer set stored in each memory page of said group address pointer memory layer addressing to part of said memory pages of said section address pointer memory layer, each address pointer set stored in each memory page of said section address pointer memory layer addressing to part of said memory pages of said word address pointer memory layer, and each address pointer set stored in each memory page of said word address pointer memory layer addressing to part of said memory tables of said basic memory layer.

2. A voice address/data memory as claimed in claim 1, wherein each memory page includes a plurality of memory segments, each of which stores an address pointer, and an ending recognition code for indicating whether the addressing to the other memory layer should be ended.

3. A voice address/data memory as claimed in claim 2, wherein each memory segment further stores an attribute for defining the voice parameters of said basic voice data units.

4. A voice address/data memory as claimed in claim 3, wherein said basic memory layer and said trigger, group, section and word address pointer memory layers are arranged within continuous memory regions of said voice address/data memory.

5. A voice address/data memory as claimed in claim 4, wherein said ending recognition code utilizes a binary code "11111111" to indicate that the addressing to the other memory layer should be ended.

6. A voice address/data memory as claimed in claim 4, wherein said ending recognition code utilizes a binary code "00000000" to indicate that the addressing to the other memory layer should be ended.

* * * * *